US005775224A

United States Patent [19]

Hauck

[11] Patent Number: 5,775,224

[45] Date of Patent: Jul. 7, 1998

[54] SHEET DELIVERY IN PRINTING PRESSES

[75] Inventor: Axel Hauck, Karlsruhe, Germany

[73] Assignee: Heidelberger Druckmaschinen AG, Heidelberg, Germany

[21] Appl. No.: 566,550

[22] Filed: Dec. 4, 1995

[30] Foreign Application Priority Data

Dec. 3, 1994 [DE] Germany ..... 44 43 057.4

[51] Int. Cl.[6] ..... B41F 13/24

[52] U.S. Cl. ..... 101/232; 101/408; 271/204; 271/268

[58] Field of Search ..... 101/232, 408; 271/204, 268, 277, 82, 83

[56] References Cited

U.S. PATENT DOCUMENTS

| | | | |
|---|---|---|---|
| 3,935,814 | 2/1976 | Weisgerber | 101/232 |
| 3,960,079 | 6/1976 | Capetti | 101/232 |
| 4,290,595 | 9/1981 | Thunker | 271/277 |
| 4,869,169 | 9/1989 | Rebel et al. | 101/408 |

FOREIGN PATENT DOCUMENTS

| | | |
|---|---|---|
| 0 170 962 | 12/1988 | European Pat. Off. . |
| 21 11 049 | 3/1978 | Germany . |
| 34 29 008 | 7/1986 | Germany . |
| 37 01 103 | 4/1990 | Germany . |
| 1086965 | 10/1967 | United Kingdom . |
| 1 379 855 | 1/1975 | United Kingdom . |

OTHER PUBLICATIONS

UK Search Report.

*Primary Examiner*—Edgar S. Burr
*Assistant Examiner*—Dave A. Ghatt
*Attorney, Agent, or Firm*—Herbert L. Lerner; Laurence A. Greenberg

[57] ABSTRACT

Sheet delivery in a printing press, wherein, at acceptance of a sheet, a gripper bar of the delivery has a speed which is increased in comparison with a sheet-surrendering or transferring gripper bar includes delivery chains, and a drive for driving the chains so as to increase the speed of the gripper bar of the delivery at an instant at which a sheet is transferred to the gripper bar of the delivery by the sheet-surrendering gripper bar.

3 Claims, 3 Drawing Sheets

SHEET DELIVERY IN PRINTING PRESSES

BACKGROUND OF THE INVENTION

FIELD OF THE INVENTION

The invention relates to a sheet delivery in printing presses wherein, at the acceptance of a sheet, the gripper bar of a delivery has a speed which is increased in comparison with a sheet-surrendering or transferring gripper bar.

The increased speed serves to prevent the formation of removal streaks on the printed sheets. Such removal streaks occur when a printing press is of such construction that the transfer of a sheet to the gripper bar of the delivery occurs at an instant of time at which the end of the sheet remains yet on the rubber-blanket cylinder, no provision having been made for an increased speed of the gripper bar of the delivery.

In printing presses, the sheets are removed from the rubberblanket cylinder not at the line of contact between the rubber-blanket cylinder and the impression cylinder, but rather, at a line situated after the line of contact, as viewed in the direction of rotation of the rubber-blanket cylinder. The reason therefor is that the sheet adheres to the rubber-blanket cylinder due to the wet ink. The removal of the sheet, therefore, requires a given force, which can act on the sheet only if the sheet is not removed from the rubber-blanket cylinder tangentially, but at a given angle. When the front or leading end of the sheet is transferred from the gripper bar of a cylinder, for example, the impression cylinder, to the gripper bar of the delivery, the following effect occurs:

The gripper bar of the delivery is not as stably supported as the gripper bars on the cylinders. It is attached by its ends to the chains of the delivery and revolves with the chains. When accepting the sheet, the gripper bar of the delivery is disposed on two sprocket wheels, which reverse the direction of the chains of the delivery. Due to the fact that the gripper bar is mounted on the chains and, furthermore, only by the ends thereof, deflection occurs under load. Furthermore, the bearings on the chains are subject to play. When the gripper bar of a cylinder surrenders the leading or front end of the sheet to the gripper bar of the delivery, and after the grippers of the cylinder have released the sheet, the aforementioned deflection occurs, as well as a yielding of the bearings of the gripper bar until the play has been compensated. In this manner, tension in the sheet is reduced. Consequently, the removal of the sheet from the rubber-blanket cylinder is interrupted or delayed for a brief time period, whereafter it resumes once the play has been overcome and the deflection has taken place. This discontinuity in the removal of the sheet from the rubber-blanket cylinder results in the formation of a removal streak which is visible on the printed image.

In order to prevent such removal streaks, it has been proposed heretofore in the published German Patent Document DE 37 01 103 C2 that the gripper bar of the delivery be supported in a swivelable manner, so that, at the instant of transfer of the sheet, the grippers undergo an additional forward movement, thereby assuring the continuity of the removal of the sheet from the rubber-blanket cylinder. Provided for the swiveling of the gripper bar is a cam with a gripper-control roller running therein. This is an elaborate mechanism susceptible to faults and wear.

SUMMARY OF THE INVENTION

It is accordingly an object of the invention to provide an improved sheet delivery in printing presses wherein an increased speed of the gripper bar thereof is achieved in a manner which is simple, highly reliable and as free of wear as possible.

With the foregoing and other objects in view, there is provided, in accordance with the invention, a sheet delivery in a printing press, wherein, at acceptance of a sheet, a gripper bar of the delivery has a speed which is increased in comparison with a sheet-surrendering or transferring gripper bar, comprising delivery chains, and a drive for driving the chains so as to increase the speed of the gripper bar of the delivery at an instant at which a sheet is transferred to the gripper bar of the delivery by the sheet-surrendering gripper bar.

In accordance with another feature of the invention, the delivery includes a delivery drum, and a transmission unit for connecting the delivery drum to a drive of the printing press, the chains being driven by the delivery drum, and the transmission unit serving for increasing the speed of the gripper bar of the delivery.

In accordance with a further feature of the invention, the transmission includes a driving gearwheel for driving the delivery drum, the driving gearwheel having a bearing formed with an eccentricity so that the driving gearwheel has a longer and a shorter radius, the driving gearwheel being in operative engagement with a driving gear train of the printing press, and being operatively connected with the longer axis thereof to the driving gear train of the printing press at the instant of transfer of the sheet to the gripper bar of the delivery, the transmission and the driving gear train of the printing press having a tooth play adequate for accommodating a variation in spacing distances due to the eccentricity.

In accordance with a concomitant feature of the invention, the sheet delivery includes a four-bar linkage for driving the delivery drum.

The construction according to the invention offers the advantage that the gripper bar of the delivery can be connected more stably to the chains, and elaborate mechanisms for achieving the swiveling of the gripper bar and tending to be readily susceptible to failure can be dispensed with.

The chains may be driven in various ways. The chains of the delivery may be provided with their own drive which, for example, is suitably controlled through the intermediary of an electronic control. However, the chains may also be driven by the delivery drum which is connected to the drive of the printing press by a gear transmission unit, which serves to increase the speed of the gripper bar of the delivery.

All types of transmission units which satisfy the condition that one revolution of the impression cylinder should be equivalent to one revolution of the delivery drum may be used. For example, the delivery drum may be connected to the drive of the printing press by a four-bar linkage.

A further possibility is that the delivery drum be driven by means of a driving gearwheel having a bearing formed with an eccentricity, the driving gearwheel being operatively engageable, at the longer radius thereof resulting from the eccentricity, with the driving gear train of the printing press, at the instant of transfer of the sheet, the tooth play in the gear transmission unit accommodating a variation in spacing distances due to the eccentricity. This construction of the gear transmission unit represents a particularly simple, low-cost and robust possibility for achieving the increased speed of the gripper bar of the delivery.

Other features which are considered as characteristic for the invention are set forth in the appended claims.

Although the invention is illustrated and described herein as embodied in a sheet delivery of printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
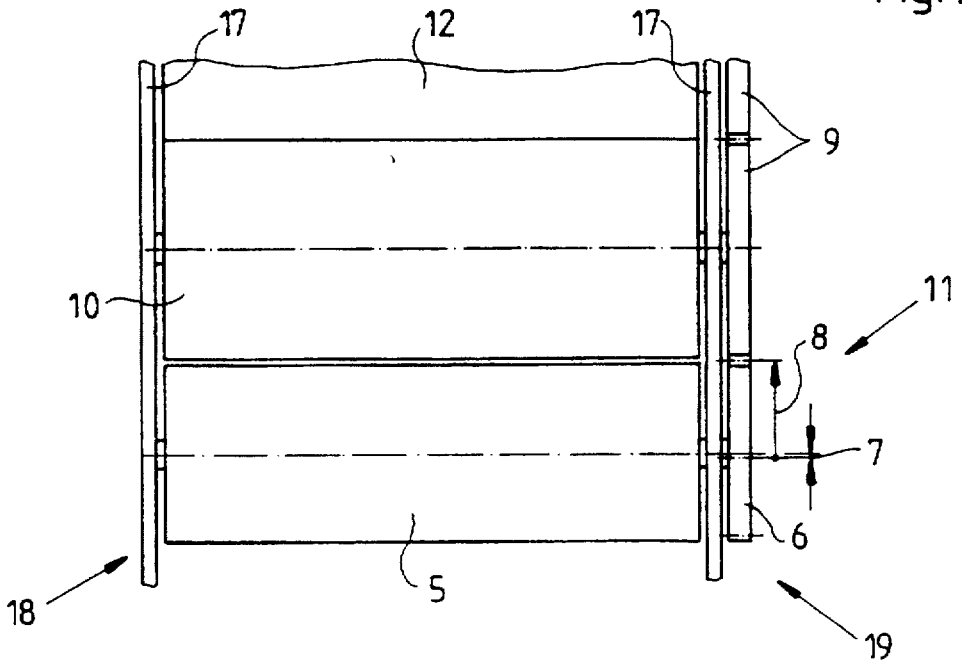
FIG. 1 is a fragmentary diagrammatic end elevational view of a printing press incorporating the invention of the instant application.
Figure 2:
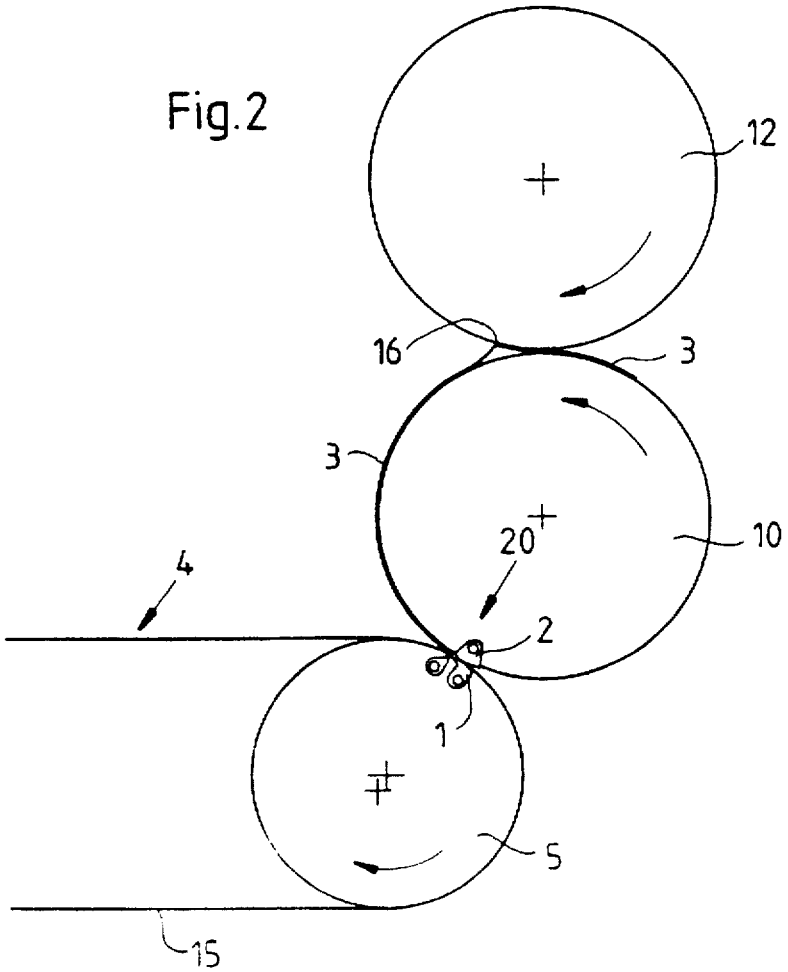
FIG. 2 is a diagrammatic side elevational view of FIG. 1 showing a rubber-blanket cylinder, an impression cylinder and a delivery drum.

Referring now to the drawings and, first, particularly to FIG. 1 thereof, there is shown therein a printing press having a rubber-blanket cylinder 12, an impression cylinder 10 and a delivery drum 5 rotatably mounted between side walls 17 of an operator side 18 and of a drive side 19 of the printing press. The impression cylinder 10 and the delivery drum 5 have gripper bars which are not illustrated in FIG. 1. The gripper bars are situated at a line of contact between the impression cylinder 10 and the delivery drum 5. Located at the drive side 19 is a driving gear train 9, which drives all the cylinders and drums of the printing press. A driving gearwheel 6 of the delivery drum 5 is operatively connected to the driving gear train 9, an eccentricity 7 of the driving gearwheel 6 ensuring an increased speed of a gripper bar 1 of the delivery 4 at the instant of transfer of a sheet 3, as shown in FIG. 2. At the instant of transfer of the sheet 3, the driving gearwheel 6 is in engagement with the longer radius 8 thereof. The tooth play between the driving gearwheel 6 and the gearwheel meshing therewith must be such that the occurring changes in spacing are possible.

FIG. 2 is a diagrammatic side elevational view of the printing press showing a rubber-blanket cylinder 12, an impression cylinder 10 and a delivery drum 5. The positions of these cylinders in FIG. 2 are the same as those shown in FIG. 1. Represented in FIG. 2 is the instant of transfer of the front or leading edge of the sheet 3 from the surrendering or transferring gripper bar 2 of the impression cylinder 10 to the gripper bar 1 of the delivery 4. The end of the sheet 3 is remains yet on the rubber-blanket cylinder 12, it being apparent that the removal taking place at 16 of the sheet 3 from the rubber-blanket cylinder 12 has not yet been completed and occurs at a line which, as viewed in the direction of rotation, is after the line of contact between the rubber-blanket cylinder 12 and the impression cylinder 10. Consequently, it is possible for the sheet 3 to be subjected to forces which lead to a removal of the sheet 3 from the rubber-blanket cylinder 12. The adhesion force of the wet ink is overcome in this manner. At transfer, the surrendering gripper bar 2 is still closed, and the gripper bar 1 of the delivery 4 also grips the sheet 3. For this purpose, the individual grippers of the two gripper bars 1 and 2 are appropriately offset with respect to one another. The play and deflection of the gripper bar 1 of the delivery 4 are overcome by the increased speed of the gripper bar 1, it being noted that, even before opening, tensile force is taken over by the gripper bar 1 and, when the sheet-surrendering gripper bar 2 opens, the tensile force required for streak-free removal acts upon the sheet 3. The occurrence of a removal streak on the printed image of the sheet 3 is prevented in this manner. The gripper bar 1 of the delivery 4 is connected by the ends thereof to the chains 15 of the delivery 4 and moves along the path of the chains 15, thus transporting the sheet 3 onto the delivery pile. The delivery drum 5 may be in the form of a drum or, alternatively, just two sprocket wheels may be interconnected by a shaft, the sprocket wheels, for example, being connected by bars, thus creating a drum-like shape. It is essential, in this regard, that the sheets 3 be guided in smear-free manner on the delivery drum 5.

A correct transfer of the sheet 3 from the sheet-surrendering gripper bar 2 is achieved , because the gripper pads of the two gripper bars 1 and 2 are at the required height and, due to a stable mounting of the gripper bar 1 on the chains 15, the height does not change during transfer.

Figure 3:
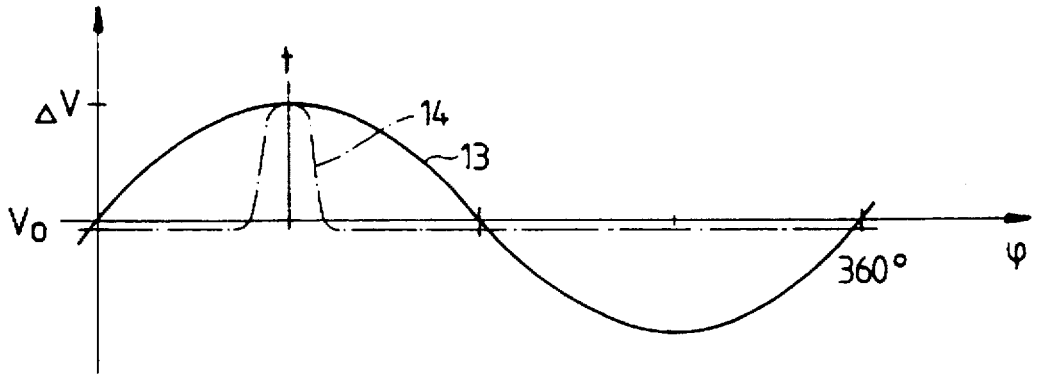
FIG. 3 is a plot diagram depicting, by way of example, speed differences between the gripper bar of the sheet delivery and the surrendering or transferring gripper bar in accordance with the invention.

FIG. 3 is a plot diagram or graph showing possible speed differences $\Delta V$ of the gripper bar 1 of the delivery 4 with respect to the speed $V_0$ of the sheet-surrendering gripper bar 2.

The speed of the sheet-surrendering gripper bar 2 is plotted as $V_0$ or, in words, the zero line of the graph. Shown on the abscissa is the angular position $\alpha$ of the impression cylinder 10 and the delivery drum 5, one revolution of both being completed at 360°. If the gear transmission unit 11 is in the form of an eccentrically mounted driving gearwheel 6 which is in engagement with the driving gear train 9, a sinusoidal curve 13 is produced. The gripper bar 1 of the delivery 4 is at its highest speed at the instant of transfer t of the sheet 3. Such a sinusoidal distribution of the difference of speed $\Delta V$ is unnecessary, and it may have a different form. However, the construction of the driving gearwheel 6 with the eccentricity 7 is a very simple embodiment with which it is possible to implement a high circumferential speed and which, consequently, is well suited for high-speed printing presses.

A further possible curve of a speed difference $\Delta V$ is represented by the phantom or dot-dash line 14. In this case, the increased speed occurs only at the instant of transfer t of the sheet 3, whereafter the speed drops to an amount required to ensure that the delivery drum 5 completes one revolution in the same time as the impression cylinder 10. Such a speed distribution may be achieved, for example, by controlling a separate drive of the chains 15. It is also possible, by a suitable embodiment of the gear unit 11, to obtain a speed curve equivalent to or approaching the speed represented by the line 14. A person even of ordinary skill in the art has many options available to him for producing or obtaining such embodiments of the gear unit 11.

Figure 4:
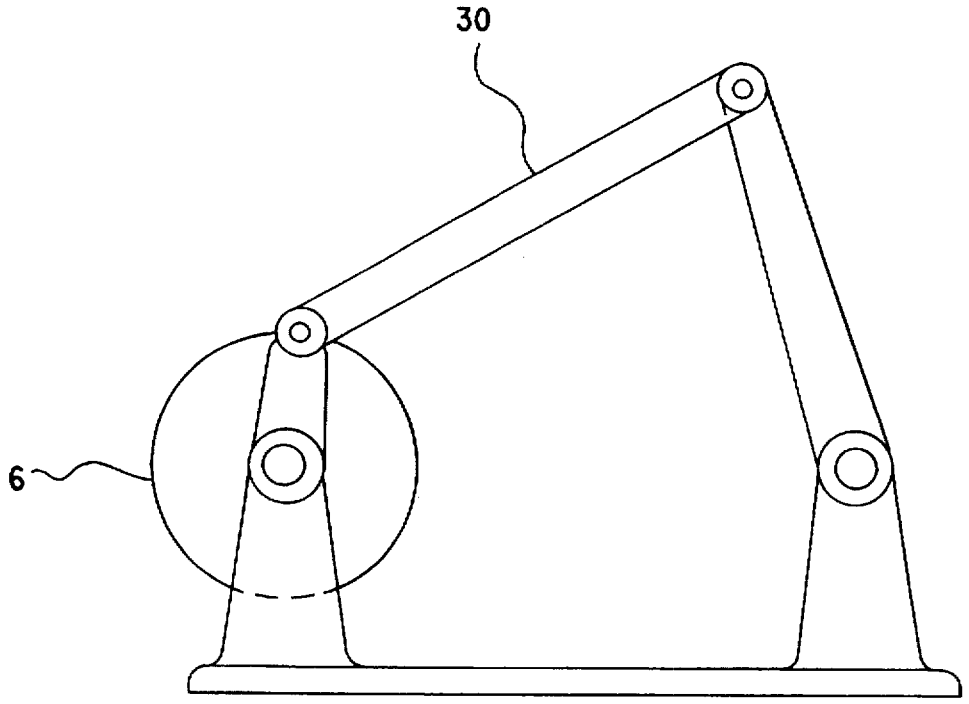
FIG. 4 is a diagrammatic, side-elevational view of a four-bar linkage driving a driving gear wheel.

All types of transmission units 11 which satisfy the condition that one revolution of the impression cylinder 10 should be equivalent to one revolution of the delivery drum 5 may be used. For example, the delivery drum 5 may be connected to the drive of the printing press by a four-bar linkage 30 as shown in FIG. 4.

I claim:

1. Sheet delivery system in a printing press having an impression cylinder, the impression cylinder having impression cylinder gripper bars and driven by a driving gear train, the sheet delivery system comprising:

a sheet delivery having chains;

gripper bars attached to said chains for receiving sheets from impression cylinder gripper bars of a printing press;

a driving gear wheel connected to and driving said sheet delivery, said driving gear wheel being eccentrically mounted on said sheet delivery and having a longer radius, said driving gear wheel being driven by a driving gear train of the printing press, said longer radius of said driving gear wheel being positioned for engaging the driving gear train when the sheets are transferred from the impression cylinder gripper bars to said gripper bars of said sheet delivery; and said driving gear wheel increasing a speed of said gripper bars after said gripper bars receive the sheets due to said eccentrical mounting of said driving gear wheel in relationship to a speed of the impression cylinder gripper bars.

2. Sheet delivery according to claim 1, wherein said driving gear wheel and the driving gear train of the printing press having a tooth play adequate for accommodating a variation in spacing distances due to said eccentricity.

3. A sheet delivery system in a printing press having an impression cylinder with impression cylinder gripper bars, the sheet delivery system comprising:

a sheet delivery having chains;

gripper bars attached to said chains for receiving sheets from impression cylinder gripper bars of a printing press;

a driving gear wheel driving said sheet delivery;

a four-bar linkage system driving said driving gear wheel; and said four-bar linkage system connected to said driving gear wheel to increase a speed of said gripper bars after said gripper bars receive the sheets in relationship to a speed of the impression cylinder gripper bars.

* * * * *